US006942427B1

(12) United States Patent
Srinivasan

(10) Patent No.: US 6,942,427 B1
(45) Date of Patent: Sep. 13, 2005

(54) COLUMN-STABILIZED FLOATING STRUCTURE WITH TELESCOPIC KEEL TANK FOR OFFSHORE APPLICATIONS AND METHOD OF INSTALLATION

(76) Inventor: Nagan Srinivasan, 3323 Double Lake Dr., Missouri City, TX (US) 77459

( * ) Notice: Subject to any disclaimer, the term of this patent is extended or adjusted under 35 U.S.C. 154(b) by 0 days.

(21) Appl. No.: 10/838,055

(22) Filed: May 3, 2004

Related U.S. Application Data

(60) Provisional application No. 60/467,373, filed on May 3, 2003.

(51) Int. Cl.[7] ..... E02D 23/02; E02B 17/08

(52) U.S. Cl. ..... 405/210; 405/203; 405/205; 114/264; 114/266

(58) Field of Search ..... 405/201, 210, 405/203–207; 114/264, 266, 267; 441/4

(56) References Cited

U.S. PATENT DOCUMENTS 3,091,089 A * 5/1963 Gellerstad ..... 405/206
3,778,854 A * 12/1973 Chow ..... 441/4
RE29,167 E 4/1977 Lloyd, III
4,187,038 A * 2/1980 Taylor ..... 405/204
4,232,625 A 11/1980 Goren et al.
4,303,352 A * 12/1981 Marion ..... 405/207
5,558,467 A 9/1996 Horton
5,609,442 A * 3/1997 Horton ..... 405/205
5,722,797 A 3/1998 Horton, III
5,803,668 A * 9/1998 Seki et al. ..... 405/204
6,024,040 A 2/2000 Thomas
6,206,614 B1 3/2001 Blevins et al.
6,431,107 B1 * 8/2002 Byle ..... 114/264
6,652,192 B1 11/2003 Xu et al.

FOREIGN PATENT DOCUMENTS

JP 58117115 * 7/1983 ..... 405/205

* cited by examiner

*Primary Examiner*—Jong-Suk (James) Lee
(74) *Attorney, Agent, or Firm*—Kenneth A. Robby

(57) ABSTRACT

A floating offshore fluid storage caisson platform has a large diameter vertically oriented buoyant column or caisson, or multiple caissons, defining a storage chamber, and a telescopic keel tank disposed at the bottom end thereof, and may have deck on top of the caisson to support storage, drilling and production structures, equipment, and quarters. The structure can be transported horizontally either dry on a transporting vessel or towed with its keel tank in a fully retracted position. At the field of operation, the structure initially floats horizontally. The keel tank is extended and then slowly flooded to move the center of gravity of the structure toward the keel tank and with the heavier tank, the structure tilts upright to assume an operating vertical position with the telescopic keel tank extended downward with respect to the caisson, and thereafter as the storage chamber is filled with fluid, the relative position of the keel tank is adjustably tuned to raise or lower the center of gravity of the entire mass of the structure with respect to its center of buoyancy and maintain the center of gravity of the structure below its center of buoyancy and stabilize the structure vertically at a desired draft according to ballast and variable or fixed loads, and to compensate for different operational, environmental and installation stages of the structure.

15 Claims, 2 Drawing Sheets

COLUMN-STABILIZED FLOATING STRUCTURE WITH TELESCOPIC KEEL TANK FOR OFFSHORE APPLICATIONS AND METHOD OF INSTALLATION

CROSS REFERENCE TO RELATED APPLICATION

This application claims priority of U.S. Provisional Application Ser. No. 60/467,373, filed May 3, 2003.

BACKGROUND OF THE INVENTION

1. Field of the Invention

This invention relates generally to offshore oil or gas production, oil or gas storage, and offloading and deepwater floating structures used in such applications, and more particularly a floating offshore vertical caisson storage platform structure with a telescoping keel tank for use in oil drilling and production and oil or gas storage operations.

2. Background Art

The purpose of offshore oil development is to build reliable structures to produce and to transport oil and gas. The cost and time of these developments and the risk and consequences of failure are crucial to the petroleum industry. The successes of several innovations, on the other hand, are very visible in the past two decades. Petroleum companies are very active in cost and time reduction through research and development and reengineering.

Several offshore fields around the world are pipeline dominated in the oil transportation from the offshore platform to the land based facilities. Subsea production systems with an assembly of pipes, structures, equipment and valves are further developed from past experiences of the sea-bottom pipeline technology. Industry is currently investigating the feasibility of building a seabed processing unit with piping, valves and instrumentation pumps and control systems. It may be feasible to do the entire production operation with ever growing sea-bottom technology. However, the cost and reliability of such developments with every thing on the seabed is difficult to prove.

The seabed pipeline system is expensive in the case of deepwater, in the case of poor seabed condition and also in the case of the production facility situated very far from the shore. Ship-shaped surface vessels are commonly used for oil storage.

The present independent vertical caisson fluid storage structure has all of the advantages of a SPAR and Tension Leg Platform (TLP) structure, and eliminates the need for connections to the subsea pipelines on the seabed, and provides a viable transportation alternative to pipelines. The present structure makes use of independent oil or gas production and independent oil or gas transportation, and the vertical floating caisson structure with a telescopic keel tank allows it to be positioned permanently moored for tandem above-water loading with respect to production platform and shuttle export tankers stationed on the other side of the storage structure. Tandem above-water offloading is established between the export vessel and storage caisson by quick-connect hoses, and quick connect hawsers are used between the production, storage and export units.

Independent vertical caisson oil or gas storage is efficient to accommodate large storage capacity such that continuous production is possible without interruption due to the failure of the tanker arrival in severe weather conditions. Also, the production rate is much slower compared to the export tanker capacity and thus the tanker waiting time is reduced in the offloading process.

Vertical storage also has significant advantages over the ship-shaped surface vessel storage. The ship-shape storage vessels are sensitive to the sea-surface condition and oscillate largely with surface waves. Resonant sloshing of stored oil or gas poses danger to the structure. The vertical caisson structure of the present invention, on the other hand, has minimum vertical motion for the surface waves.

Lloyd, III, U.S. Pat. RE No. 29,167 discloses a twin hull variable draft drilling vessel having a pair of laterally spaced elongated hulls with a plurality of upstanding columns spaced therealong supporting a working platform in spaced relation above the hulls a distance slightly greater than the maximum anticipated wave height. The hulls buoyantly support the vessel in a low draft floating condition with the hulls having freeboard. The hulls have ballast compartments to submerge the hulls and portions of the stabilizing columns to a distance of approximately half the effective height of the stabilizing columns, which is slightly greater than maximum anticipated wave height, to maintain the vessel in a high draft floating condition with the platform elevated above the waterline. The columns stabilize the vessel in the high draft condition about roll and pitch axes. The working platform mounts either a drilling rig or a heavy duty crane or like operational equipment along the centerline of the vessel.

Goren et al, U.S. Pat. No. 4,232,625 discloses a Column stabilized semi-submerged drilling vessel having a pair of laterally spaced elongated hulls with a pair of upstanding columns at opposite ends thereof supporting a working platform and a drilling mast in spaced relation above the hulls. The hulls buoyantly support the vessel in a low draft in-transit floating condition with the hulls having freeboard. The hulls have ballast compartments to submerge the hulls and portions of stabilizing columns such that the waterline lies intermediate the height of the columns with the platform and drilling mast elevated above the waterline. The columns stabilize the vessel in the high draft condition and the number, cross-sectional area and configuration of the columns, the weight distribution of the vessel and the geometry of the submerged hulls and portions of the columns are such that the vessel obtains motion minimizing characteristics in the high draft condition. Various features include hydrostatic and geometric properties wherein the ratio of the righting moment about the pitch axis to the righting moment about the roll axis in high draft condition is within a range of 1.0 to 1.3 while the ratio of vessel length to width lies within a range of 1.2 to 1.5; a natural period in heave in a range of 16–18 seconds; and a heave response amplitude operator in a range of about 0.35 to 0.60 in the range of waves of 10–14 seconds.

Thomas, U.S. Pat. No. 6,024,040 discloses a mobile jack-up platform converted to a semi-submersible offshore platform. The platform includes single submerged hollow lower base at the bottom end, partially submerged elongate vertical buoyant connecting legs extending upwardly therefrom and passing through an upper barge (jack-up platform) above the level of the sea. The hollow base has a square, rectangular or triangular configuration and is filled with seawater to form the ballast for the entire platform and may include interior reservoirs in which hydrocarbons are stored. A central opening or passage in the center of the base reduces the resistive surface size of the base in the water during vertical movements of the platform. The vertical connecting legs have a hollow cylindrical upper portion with a bottom wall forming a buoyancy tank, and a lower portion formed of open frame lattice construction. The respective lengths of the hollow cylindrical buoyant upper portion and the lattice-work lower portions are dimensioned relative to one another so that a pressure force exerted by the sea on the upper portions substantially compensates for an acceleration force exerted on the base by the action of the seawater surrounding the base over a usual swell period range of the sea. The platform in operation imitates a semi-submersible, which can retract the legs with respect to the upper barge (jack-up platform). With the legs fully retracted above the upper barge and its single lower base closely adjacent to the bottom of the upper barge, the platform can be floated and transported to another location.

Horton, U.S. Pat. No. 5,558,467 discloses a spar-type deep water offshore floating apparatus for use in oil drilling and production in which an upper buoyant hull of prismatic shape is provided with a passage longitudinally extending through the hull in which risers run down to the sea floor, the bottom of the hull being located at a selected depth dependent upon the wind, wave, and current environment at the well site, which significantly reduces the wave forces acting on the bottom of the hull, a frame structure connected to the hull bottom and extending downwardly and comprising a plurality of vertically arranged bays defined by vertically spaced horizontal water entrapment plates and providing open windows around the periphery of the frame structure, the windows providing transparency to ocean currents and to wave motion in a horizontal direction to reduce drag, the vertical space between the plates corresponding to the width of the bay window, the frame structure being below significant wave action whereby wave action thereat does not contribute to heave motion of the apparatus but inhibits heave motion, the frame structure serving to modify the natural period and stability of the apparatus to minimize heave, pitch, and roll motions of the apparatus. A keel assembly at the bottom of the frame structure has ballast chambers for enabling the apparatus to float horizontally and for stabilization of the apparatus against tilting in vertical position, and taut anchor lines connected to the apparatus at a location of relatively little cyclic movement of the apparatus, the said lines being connected to suitable anchors.

Horton, III, U.S. Pat. No. 5,722,797 discloses a spar-type buoyant floating caisson for offshore drilling and production that includes means for increasing the natural period of the caisson and reducing heave, pitch, and roll without increasing the overall length of the caisson. The floating caisson has a center well through which drilling and/or production risers pass and one or more circular plates extend radially from the caisson below the water surface. The circular plates provide additional mass and resistance to environmentally induced motions and thus increases the natural period of the caisson beyond the periods of maximum wave energy, which allows the caisson to be designed with a shallower draft than a caisson without the plates that would normally be used in deep water.

Blevins et al, U.S. Pat. No. 6,206,614 discloses a spar-type floating offshore drilling/producing structure that is formed from a plurality of closely spaced vertically oriented buoyant columns on which one or more modules or decks may be placed to support process equipment, a drilling rig, utilities, and accommodations for personnel. The columns are held in the closely spaced relationship by a plurality of horizontal plates spaced along the length of the columns and vertical plates located near the bottom of the columns and near the top of the columns. The columns have a smaller water plane area than the horizontal plates. The structure includes fixed ballast, an oil storage area, and voids and variable ballast for offsetting the lighter weight of the stored oil.

Xu et al, U.S. Pat. No. 6,652,192 discloses a heave suppressed, floating offshore drilling and production platform having vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed for buoyantly lifting the platform so that the deck is at the desired elevation above the water surface.

The present invention is distinguished over the prior art in general, and these patents in particular by a floating offshore vertical caisson fluid (oil or gas) storage platform having a large diameter vertically oriented buoyant column or caisson, or multiple caissons, defining a storage chamber, and a telescopic keel tank disposed at the bottom end thereof, and may have deck on top of the caisson to support storage, drilling and production structures, equipment, and quarters. The structure can be transported horizontally either dry on a transporting vessel or towed with its keel tank in a fully retracted position. At the field of operation, the structure initially floats horizontally. The keel tank is extended and then slowly flooded to move the center of gravity of the structure toward the keel tank and with the heavier tank, the structure tilts upright to assume an operating vertical position with the telescopic keel tank extended downward with respect to the caisson, and thereafter as the storage chamber is filled with fluid, the relative position of the keel tank is adjustably tuned to raise or lower the center of gravity of the entire mass of the structure with respect to its center of buoyancy and maintain the center of gravity of the structure below its center of buoyancy and stabilize the structure vertically at a desired draft according to ballast and variable or fixed loads, and to compensate for different operational, environmental and installation stages of the structure.

The telescopic spindle and keel tank of the present structure is used both in the installation of the caisson and also in the storage operation. In the loading and offloading operation, the center of gravity of the storage caisson structure will move significantly in the vertical direction. The keel tank is efficiently telescoped up and down and also is partially ballasted to maintain the center of gravity below the center buoyancy of the structure. Cantilevered booms situated on top of the deck facilitate quick connect and disconnect of loading and offloading hoses and maintain them completely above the water during the loading and offloading operation between the floating storage platform and a production platform and export shuttle tanker.

SUMMARY OF THE INVENTION

It is therefore an object of the present invention to provide an independent floating offshore fluid (oil or gas) storage structure in which most of the operations and equipment are maintained dry above the water, and a cost effective method of transporting the fluid (oil or gas) to the shore without the use of the sea bottom pipelines.

It is another object of this invention to provide an independent vertical caisson fluid (oil or gas) storage structure having a large storage capacity such that continuous production is possible without interruption due to failure of export shuttle tanker arrival in severe weather conditions, and having a slower production rate compared to the export tanker capacity and thereby reduce tanker waiting time in the offloading process.

Another object of this invention is to provide an independent vertical caisson fluid (oil or gas) storage structure having a telescopic keel tank that efficiently controls and maintains the center of gravity of the structure always below its center of the buoyancy to make the storage vessel stable in its floating condition.

Another object of this invention is to provide independent vertical caisson fluid (oil or gas) storage structure having a telescopic keel tank that allows continuous production operations independent of export tanker downtime.

Another object of this invention is to provide independent vertical caisson fluid (oil or gas) storage structure having a telescopic keel tank that will eliminate expensive seabed pipeline and subsea production systems in very deepwater locations, in poor seabed conditions, in locations wherein the storage structure is very far from the production facility, and for compliance with ecological, environmental, or government regulations.

Another object of this invention is to provide independent vertical caisson fluid (oil or gas) storage structure having a telescopic keel tank that has rotating base booms situated on the top of the deck structure supporting flow conduits for the loading and offloading of fluids.

Another object of this invention is to provide independent vertical caisson fluid (oil or gas) storage structure having a telescopic keel tank that has loading and unloading hoses that are quickly connected and disconnected from independent production platforms and independent export shuttle vessels.

Another object of this invention is to provide independent vertical caisson fluid (oil or gas) storage structure having a telescopic keel tank that has tandem above-water loading and unloading hoses that allow visual inspection and fast identification of functioning and/or failures, and thus immediate remedy.

A further object of this invention is to provide independent vertical caisson fluid (oil or gas) storage structure having a telescopic keel tank that greatly reduces the cost of operation and transportation in deepwater depths.

A still further object of this invention is to provide independent vertical caisson fluid (oil or gas) storage structure having a telescopic keel tank that significantly improves the reliability of fluid (oil or gas) production, storage and transportation operations.

Other objects of the invention will become apparent from time to time throughout the specification and claims as hereinafter related.

The above noted objects and other objects of the invention are accomplished by a floating offshore vertical caisson fluid (oil or gas) storage platform having a large diameter vertically oriented buoyant column or caisson, or multiple caissons, defining a storage chamber, and a telescopic keel tank disposed at the bottom end thereof, and may have deck on top of the caisson to support storage, drilling and production structures, equipment, and quarters. The structure can be transported horizontally either dry on a transporting vessel or towed with its keel tank in a fully retracted position. At the field of operation, the structure initially floats horizontally. The keel tank is extended and then slowly flooded to move the center of gravity of the structure toward the keel tank and with the heavier tank, the structure tilts upright to assume an operating vertical position with the telescopic keel tank extended downward with respect to the caisson, and thereafter as the storage chamber is filled with fluid, the relative position of the keel tank is adjustably tuned to raise or lower the center of gravity of the entire mass of the structure with respect to its center of buoyancy and maintain the center of gravity of the structure below its center of buoyancy and stabilize the structure vertically at a desired draft according to ballast and variable or fixed loads, and to compensate for different operational, environmental and installation stages of the structure.

DESCRIPTION OF THE PREFERRED EMBODIMENT

Figure 1:
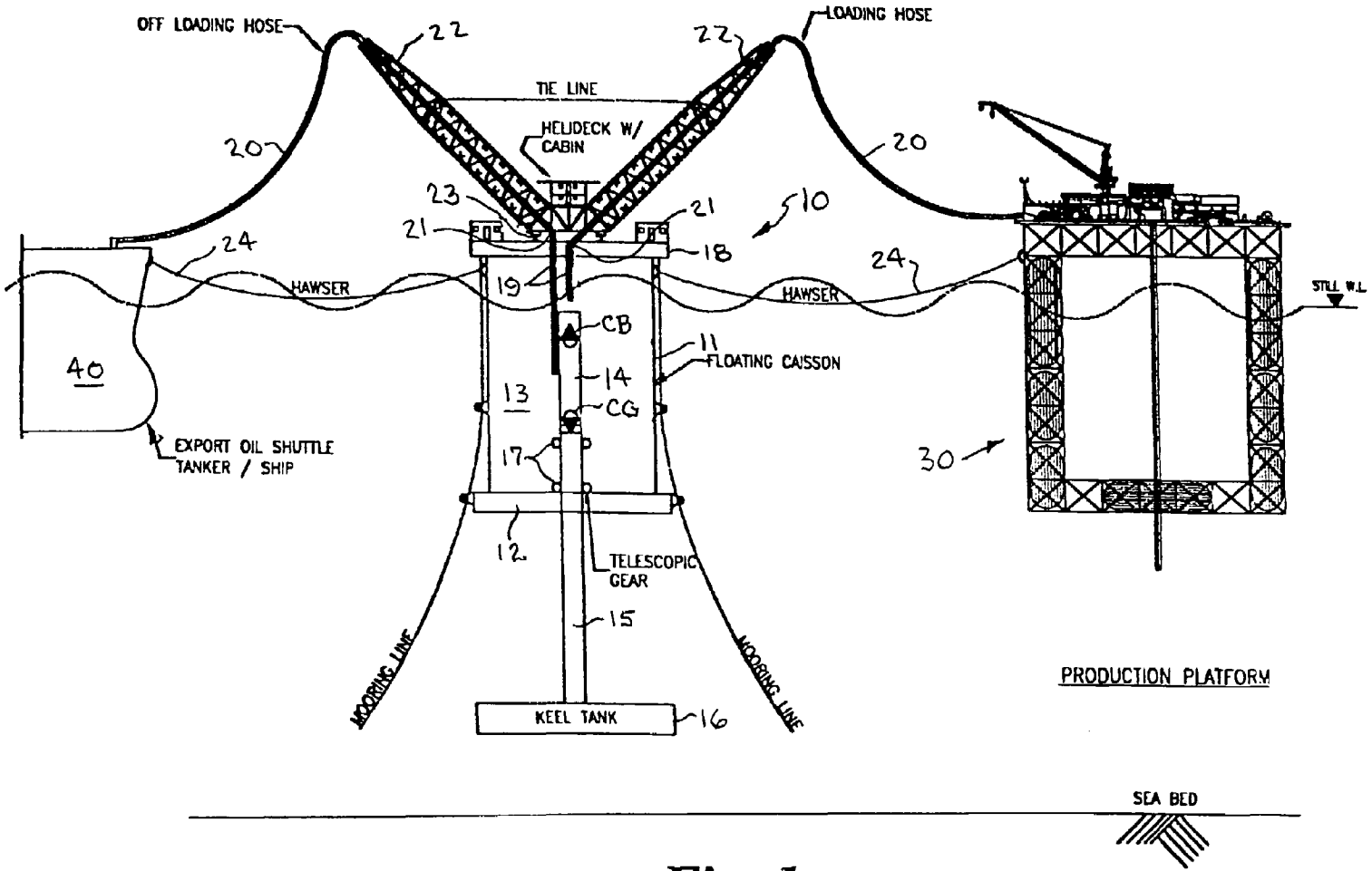
FIG. 1 is a schematic perspective view of a moored floating offshore storage floating caisson platform having a telescopic keel tank, and a floating drilling and production platform structure in accordance with the present invention.

Referring to the drawings by numerals of reference, there is shown somewhat schematically in FIG. 1, a preferred moored floating offshore storage caisson platform 10 having a telescopic keel tank in accordance with the present invention moored adjacent to a floating drilling and production platform structure 30. The storage platform 10 is shown positioned permanently moored for tandem above-water loading with respect to the production platform 30, and offloading via an export shuttle tanker 40 stationed on the other side of the storage structure. It should be understood that the drilling and production platform structure 30 may be a fixed facility, for example, a liquid natural gas (LNG) facility.

The moored floating offshore storage caisson platform 10 has a large diameter central buoyant column or caisson 11 with a base 12 enclosing its bottom end and defining a central storage chamber 13. A central cylindrical column 14 is mounted vertically in the storage chamber 13. An elongate spindle 15 extends through the base 12 and is slidably and telescopically mounted within the cylindrical column 14 and is engaged with a raising and lowering mechanism 17 on the base, such as a gear assembly or other conventional raising and lowering means for extensible and retractable movement relative to the platform 10. A keel tank 16 is mounted at the bottom end of the spindle 15. One or more automatic control systems are provided to telescope the spindle 15 and to lock it at any desired length, and pump control means for selectively pumping water in and out of the keel tank 16 to partially or fully flood the keel tank and thereby adjust the weight and ballast. One or more locking mechanisms are provided in the central storage chamber 13 to lock the telescopic spindle 15 and keel tank 16 at its bottom end with respect to the caisson 11. The structure 10 may also be equipped with oil or gas storage areas or compartments and fixed and variable ballast capsules or tanks within or around the caisson 11.

When deployed at the field of operation, the structure 10 floats in an operating vertical position with the telescopic keel tank 16 extended downwards. A deck 18 may be secured on top of the caisson 11 to support storage, drilling and production structures, equipment, generators, refrigeration systems, and living and working quarters.

Figure 2B:
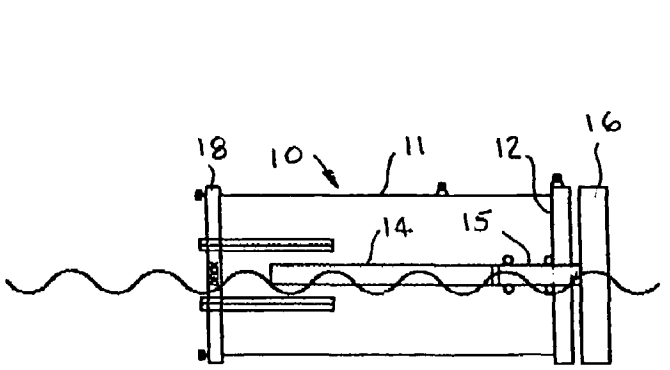
FIGS. 2A–2D are schematic illustrations showing the steps in transporting and installing the storage floating caisson platform in accordance with the present invention.
Figure 2A:
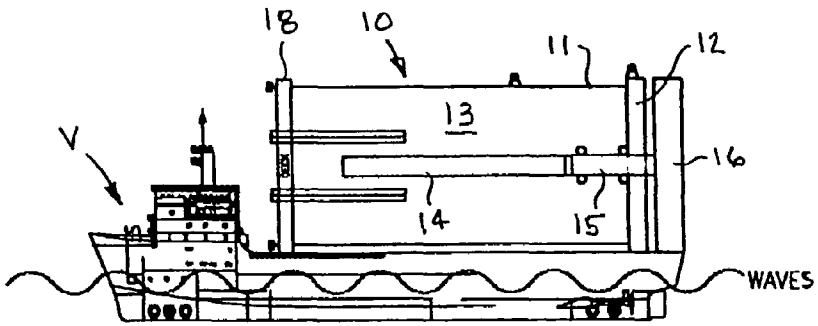
Figure 2D:
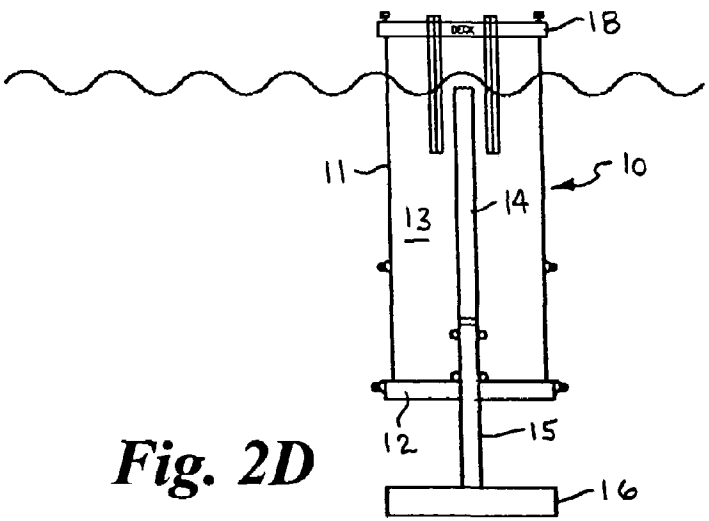

As shown schematically in FIGS. 2A–2D, the structure 10 can be transported horizontally either dry on a transporting vessel V (FIG. 2A) or wet with the help of towing tug boats with its spindle 15 and keel tank 16 telescoped in a fully retracted and locked position. At the field of operation, the structure 10 initially floats horizontally (FIG. 2B). The spindle 15 with its keel tank 16 is telescopically extended and locked in position. The keel tank 16 is then slowly flooded.

Figure 2C:
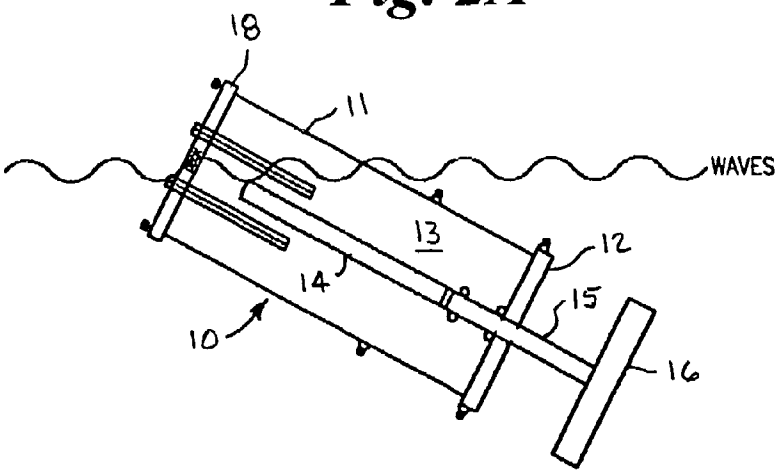

With the heavier keel tank, the center of gravity CG of the structure 10 is moved towards the keel tank 16, and the structure tilts upright by itself with the keel tank down (FIG. 2C). In the vertical upright position (FIG. 2D and FIG. 1), if auxiliary floatation capsules or tanks are provided inside or around the caisson 11, they are flooded selectively and sufficiently to float the structure vertically at its desired submerged draft. The keel tank 16 in its telescopically extended position and partially or fully flooded, controls the positioning of the center of gravity CG of the structure below its center of buoyancy CB and maintains the structure stable in its self-floating vertical condition.

Referring again to FIG. 1, the structure 10 is shown equipped for used as an independent offshore floating fluid storage and offloading unit. Fluid pipes or conduits 19 are provided for loading and offloading of crude oil or gas through pipes or hoses 20 to and from the floating storage structure 10. The loading and offloading fluid pipes or conduits 19 are connected with the storage structure through swivel joint connections 21 and their upper portions are supported on two cantilever booms 22, respectively, disposed on top of the storage structure 10. The lower end of each boom 22 is mounted on a rotatable roller platform 23. The roller platform 23 has rollers that ride on top of a circular beam with a top flange and box webs welded to the top deck of the storage structure. The upper ends of the cantilever booms 22 are cantilevered outward, one towards the production platform 30 and the other towards the export shuttle vessel 40. It should be understood that the storage chamber 13, the loading and offloading fluid conduits 19, and hoses 20 may be thermally insulated, as required, for handling fluids or gases requiring insulation.

Thus, the booms 18 with the fluid loading and offloading pipes or conduits 19 are free to rotate with respect to the storage platform about its vertical center axis. The loading and offloading hoses 20 extending from the production platform 30 and the export shuttle vessel 40 are connected to the fluid loading and offloading pipes or conduits 19 at the outer end of the respective booms. The loading and offloading hoses 20 have quick connect and disconnect type end connections and are sized for the required fluid flow capacity. Hawsers 24 having quick release yoke connections are used to tie the floating storage structure 10, the production platform 30, and the export vessel 40 together. It should be understood that the storage structure 10 may be equipped with auxiliary oil storage areas and fixed and variable ballast capsules or tanks (not shown) within or around the caisson 11 wherein the variable ballast is used for offsetting the lighter weight of the stored oil.

Although, for purposes of example, the storage platform 10 is shown positioned with respect to a floating offshore drilling and production platform 30, and offloading via an export shuttle tanker 40, it should be understood that the present storage platform 10 may be moored offshore and connected with an on-shore fixed facility, for example, a liquid natural gas (LNG) facility, in which case, the fluid is transferred from the shuttle tanker into the storage platform 10 and then is subsequently offloaded to the on-shore fixed facility.

The telescopic spindle 15 and keel tank 16 of the present floating storage structure is used both in the installation and deployment of the structure (as described previously), and also in the storage operation. In the fluid loading and offloading operation, the center of gravity of the floating storage caisson structure will move significantly in the vertical direction as it becomes filled. The spindle 15 and keel tank 16 can be efficiently telescoped up and/or down and also may be partially ballasted to always maintain the center of gravity of the structure below its center of buoyancy.

Although, for purposes of example, the present floating caisson storage structure 10 has been described as having a central single large diameter vertical buoyant column or caisson 11, it should be understood that, alternatively, the structure may be formed of multiple closely spaced vertically oriented buoyant columns or caissons 11 disposed about a telescopic spindle and keel tank. In the case of the multiple vertical columns or caissons 11, the columns or caissons are preferably held together in a compact arrangement with wall-to-wall contact with each other.

While this invention has been described fully and completely with special emphasis upon preferred embodiments, it should be understood that within the scope of the appended claims the invention may be practiced otherwise than as specifically described herein.

What is claimed is:

1. A vertical caisson floating fluid storage platform structure, comprising;

at least one vertically oriented buoyant caisson having an enclosed fluid storage chamber;

at least one keel tank movably connected with said caisson for extensible and retractable movement relative to a lower end thereof; and pump means for selectively pumping water in and out of said keel tank to adjust the weight and ballast thereof; wherein;

the relative position and weight of said keel tank is adjustably tuned to raise or lower the center of gravity of the entire mass of the structure with respect to its center of buoyancy according to ballast and variable or fixed loads including deck payloads, to stabilize the structure, and to compensate for different operational, environmental and installation stages of the structure.

2. The vertical caisson floating fluid storage platform structure according to claim 1, wherein said keel tank is is selectively retractable and extensible relative to said caisson bottom end between a transport mode, a deployment mode, and an operating mode; wherein in the transport mode said keel tank is retracted for transporting said structure offshore horizontally by towing or by carrying via a transportation barge;

in the deployment mode, said keel tank is extended, and water is pumped into said keel tank to adjust the weight thereof to move said caisson to a vertical position and impart a desired buoyancy; and in the operating mode, as said storage chamber is filled with fluid, said keel tank is extended or retracted and water is pumped into or out of said keel tank to raise or lower the center of gravity of the entire mass of the structure with respect to its center of buoyancy and maintain the center of gravity of the structure below its center of buoyancy.

3. The vertical caisson floating fluid storage platform structure according to claim 1, further comprising:

a deck platform secured to an upper end of said at least one vertical buoyant caisson.

4. The vertical caisson floating fluid storage platform structure according to claim 3, further comprising:

fluid loading and offloading means on said work platform for receiving fluids into said fluid storage chamber and removing fluids therefrom.

5. The vertical caisson floating oil storage platform structure according to claim 4, wherein said fluid loading and offloading means comprise at least one fluid loading conduit having a first end disposed in said fluid storage chamber and a second end exterior thereof adapted to be releasably connected with a loading hose connected with a fluid source.

6. The vertical caisson floating fluid storage platform structure according to claim 5, further comprising;

a cantilever boom on said deck;

an upper portion of said loading conduit being supported on said boom.

7. The vertical caisson floating fluid storage platform structure according to claim 6, further comprising;

swivel joint means connected between said loading conduit first end and said upper portion of said loading conduit supported on said cantilever boom to allow movement of said upper portion with said cantilever boom.

8. The vertical caisson floating fluid storage platform structure according to claim 6, further comprising;

a rotatable platform secured to said work deck platform; and said cantilever boom is mounted at one end on said rotatable platform; whereby said cantilever boom is rotatable with respect to said storage platform about a vertical axis extending through said storage platform.

9. The vertical caisson floating oil storage platform structure according to claim 4, wherein said fluid loading and offloading means comprise at least one fluid offloading conduit having a first end disposed in said fluid storage chamber and a second end exterior thereof adapted to be releasably connected with an offloading hose connected with either of a fluid transport vessel or a facility for receiving fluid from said storage chamber.

10. The vertical caisson floating fluid storage platform structure according to claim 9, further comprising;

a cantilever boom on said deck;

an upper portion of said offloading conduit being supported on said boom.

11. The vertical caisson floating fluid storage platform structure according to claim 10, further comprising;

swivel joint means connected between said offloading conduit first end and said upper portion of said offloading conduit supported on said cantilever boom to allow movement of said upper portion with said cantilever boom.

12. The vertical caisson floating fluid storage platform structure according to claim 10, further comprising;

a rotatable platform secured to said work deck platform; and said cantilever boom is mounted at one end on said rotatable platform; whereby said cantilever boom is rotatable with respect to said storage platform about a vertical axis extending through said storage platform.

13. A method of transporting, deploying and operating a vertical caisson floating fluid storage platform structure, the structure including at least one vertically oriented buoyant caisson having an enclosed fluid storage chamber, at least one keel tank movably connected therewith for extensible and retractable movement relative to a lower end thereof, and pump means for selectively pumping water in and out of said keel tank to adjust the weight and ballast thereof; comprising the steps of:

retracting said keel tank to a position closely adjacent to the lower end of said caisson;

transporting said fluid storage platform structure in a horizontal position to an offshore site of operation, either dry on a transporting vessel or wet by towing it with a towing vessel;

at the site of operation, extending said keel tank a distance from the lower end of said caisson, and pumping water into said keel tank to adjust the weight thereof to move said caisson to a vertical position and impart a desired buoyancy; and thereafter as said storage chamber is filled with fluid, extending or retracting said keel tank and pumping water into or out of said keel tank to raise or lower the center of gravity of the entire mass of the structure with respect to its center of buoyancy and maintain the center of gravity of the structure below its center of buoyancy according to ballast and variable or fixed loads and to compensate for different operational, environmental and installation stages of the structure.

14. The method according to claim 13, comprising the further steps of:

securing a deck platform to said upper end of said vertical buoyant caisson, the deck including fluid loading conduit means and fluid offloading conduit means for receiving fluids into said fluid storage chamber and removing fluids therefrom, respectively.

15. The method according to claim 14, comprising the further steps of:

releasably connecting said fluid loading conduit means with a fluid source;

filling said storage chamber with fluid from said source; and when transport of said fluid is desired, releasably connecting said fluid offloading conduit means with either of a shuttle tanker vessel or a fixed facility, and transferring fluid from said storage chamber thereto.

* * * * *